United States Patent [19]

Guillen

[11] 4,095,301

[45] Jun. 20, 1978

[54] PORPOISE EVACUATION BOAT

[76] Inventor: Rafael Guillen, 2258 Flintridge Dr., San Diego, Calif. 92139

[21] Appl. No.: 753,739

[22] Filed: Dec. 23, 1976

[51] Int. Cl.[2] ..... B63B 35/14

[52] U.S. Cl. ..... 9/6 R; 114/255

[58] Field of Search ..... 114/255, 258; 9/6 R, 9/11, 5

[56] References Cited

U.S. PATENT DOCUMENTS

| | | | |
|---|---|---|---|
| 2,270,690 | 1/1942 | Shannahan | 115/14 |
| 3,261,316 | 7/1966 | Puretic | 114/255 |

FOREIGN PATENT DOCUMENTS

| | | | |
|---|---|---|---|
| 1,192,027 | 10/1959 | France | 9/11 R |
| 810,344 | 3/1959 | United Kingdom | 114/255 |

*Primary Examiner*—Robert B. Reeves
*Assistant Examiner*—Edward M. Wacyra
*Attorney, Agent, or Firm*—Ralph S. Branscomb

[57] ABSTRACT

A porpoise evacuation vessel comprises a skiff-like boat having a central bay area for the temporary retention of porpoises evacuated from tuna fishing nets, there being ramps on opposite sides of the boat leading into the water and open faced wells on opposite sides of each ramp for retaining operators to haul porpoises out of the water and into the bay, subsequent to which the boat, which is jet-propelled, is driven outside the net and the porpoises are released into the open ocean by releasing a rear gate.

8 Claims, 4 Drawing Figures

PORPOISE EVACUATION BOAT

BACKGROUND OF THE INVENTION

The tuna fishing industry has been plagued in recent years with the problem of killing porpoises as the tuna fishing nets are drawn tight to catch the tuna. Porpoises are airbreathing mammals, and a certain percentage of them are entrained in the nets and are unable to escape. Despite strenuous efforts on the part of the tuna industry to spare the porpoises, including the provision of a special segment of netting which will bob beneath the water to permit the escape of most of the porpoises, a certain percentage of the animals still become panicked and cannot make their escape.

Within the few weeks preceeding the filing of this application, the tuna industry has been stricken with a crisis that threatens to drive tuna fishing boats to foreign ports and remove from San Diego one of its most coveted industries. The crisis results from the tuna industry having reached the quota of the number of porpoises it is allowed to kill for the year 1976 and thus the tuna seiners are no longer permitted to fish schools of tuna which are accompanied by porpoises. For reasons which are not entirely known, porpoises swim along with tuna schools to the extent that over 90 percent of the schools of tuna are accompanied by porpoises. Thus to fish only tuna schools unaccompanied by porpoises is clearly economically unfeasible.

The situation threatens to worsen in 1977 when the quota of porpoise deaths is halved from that of 1976, and the tuna boat captains and tuna industry are currently in the courts and in the throes of temporary restraining orders restraining the restraining orders from being enforced.

At the present time it has been the practice, at least to a certain extent, for tuna fishermen to actually dive into the water inside the tuna net as it is closed and physically throw the porpoises over the edge of the net. The few remaining porpoises which cannot escape are quite docile, and porpoises have always been known to be quite a friendly and actually happy animal. The porpoises freely acquiesce to being grabbed by the tail and the nose and being thrown over the net. However, there is a need for a more efficient way of evacuating the porpoises from within the net area and that is the point of this invention.

SUMMARY OF THE INVENTION

The invention is a small skiff-like boat which is deployed from the large tuna seiners and is powered by water jets or like propeller-free means of propulsion so that the vessel can pass freely over the net and over porpoises without endangering the net or the porpoises. The boat is provided with a cockpit area for the operator and a pair of ramps disposed on opposite gunwales of the vessel provide easy means for hauling the porpoises up and temporarily storing them in a central bay area which is preferably disposed slightly beneath the water line but need not be so. Aside each ramp area are a pair of cages or wells in which fishermen stand and as the boat is maneuvered alongside one or more porpoises the fishermen on each side of the respective ramp will quickly and efficiently haul the porpoises up the ramps and into the central bay area of the vessel. After all the porpoises have been removed from the net area, or when the bay is full, the boat is driven across the edge of the net and a tailgate is released and the porpoises pushed out into the open ocean.

The boat as proposed has been received favorably by the industry as a practical and sure-fire means of eliminating all porpoises from the tuna nets. The craft has been designed by a tuna fisherman of long experience who is familiar with the ways of porpoises and methods of fishing generally and it appears that the simple craft proposed herein is an elementary solution to a problem which could otherwise be extremely costly to the tuna fishing industry of America and American tuna consumers.

DETAILED DESCRIPTION OF THE PREFERRED EMBODIMENTS

Figure 1:
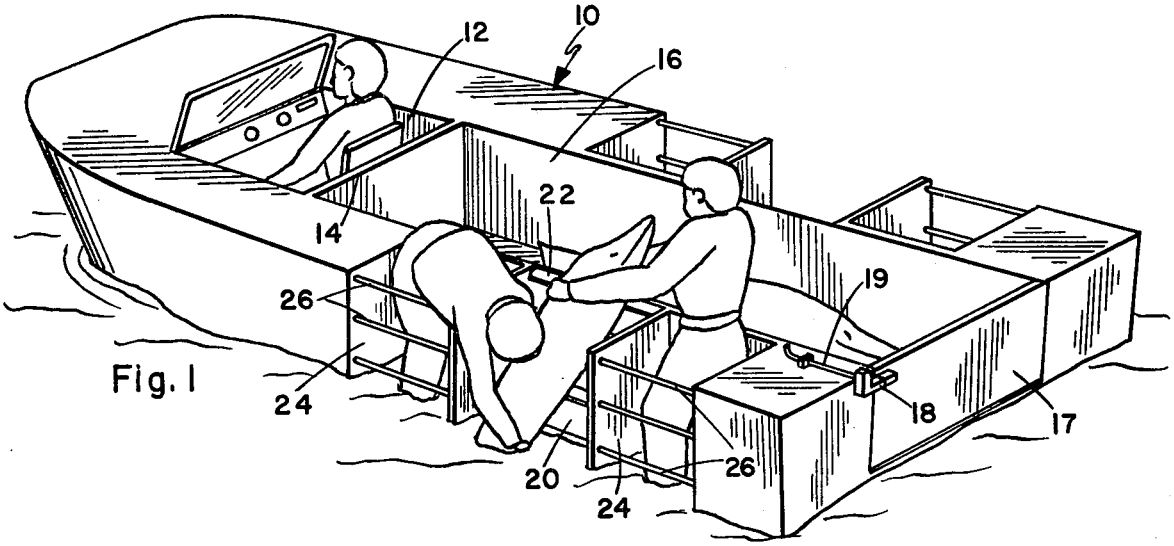
FIG. 1 is a view of the boat in use.

The vessel is shown in FIG. 1 having a body generally indicated at 10. The boat overall is small and similar to a skiff with a whaler bow for stability and has a central pilot or operator area 12 which is preferably separated from the remainder of the boat by a wall 14 or the like so that the porpoise evacuation function is completely separate and the boat operator is insulated from splashed water and porpoises generally.

Figure 2:
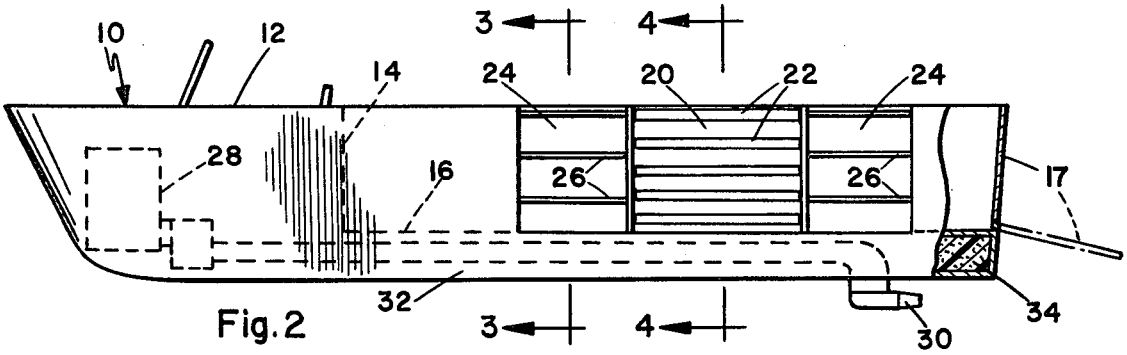
FIG. 2 is a side elevation view of the boat of FIG. 1 with portions cut away.
Figure 3:
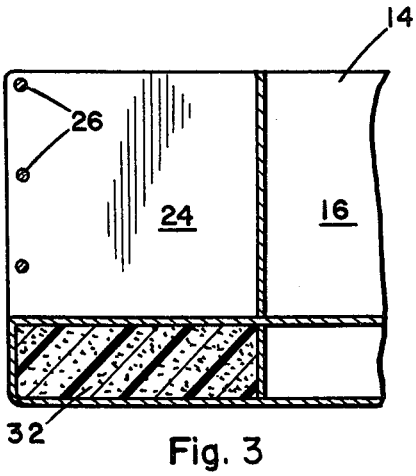
FIG. 3 is a sectional view taken along lines 3—3 of FIG. 2.
Figure 4:
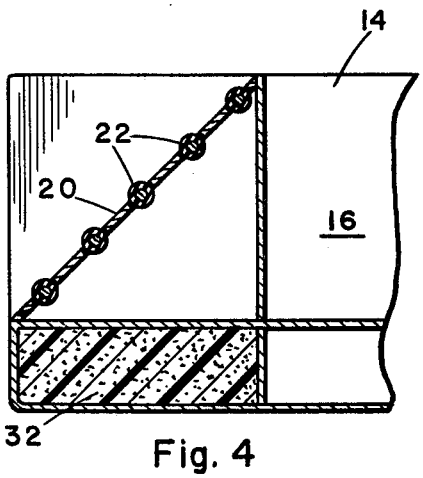
FIG. 4 is a sectional view taken along lines 4—4 of FIG. 2.

Aft of the operator area is a well 16 which as shown has a bottom which may be somewhat beneath the water level of the boat. The rear end of the well as defined by a tailgate 17 which as shown in FIG. 2 will open at or near the water level and the porpoises are free to half swim and half splash their way into the open ocean with the help of the fishermen who would ordinarily wade in the bay to complete the evacuation of the mammals. The tailgate has a latch 18 which can be released remotely by the fishermen by operating the element 19.

Along each side of the boat is a ramp 20 preferably provided with countersunk rollers 22, these ramps leading to the very edge of the central bay. As is shown in FIG. 1, a pair of operators standing in security areas which are shown as wells 24 can conveniently pull the porpoises aboard the craft and into the central well. The ramp passes beneath the water level as do the operator's cages or wells to facilitate the manipulation of the animals. The front of the wells is defined by horizontal bars 26. These bars could of course be replaced by other means, or only one bar across the top of the well could be provided so that the operators have more freedom to reach beneath the bar to grab the porpoises. As shown the operators can see through and ordinarily reach through the bars. The structure of these wells and their relation to the ramps is of course subject to some modification resulting from experimentation and actual use of the craft. The most important features are the ramps leading to the central bay area, and the operator stations disposed alongside the ramps to permit easy evacuation of the porpoises.

The propulsion system of the vessel is shown in FIG. 2 and includes a motor 28 having a propulsion nozzle 30. The propulsion unit is of course not in itself proposed to be novel and any method of propulsion which does not utilize screws or other elements the movement of which could cause damage to the porpoises and the nets could be used. It is intended that the bottom of the bay be coincidental with the bottom of the boat insofar as is feasible in view of the power train, so buoyancy is provided by air or foam flotation compartment 32 along the gunwales, and compartment 34 at the aft end of the vessel to support the rear.

The invention as herein disclosed and claimed provides a simple and elegant solution, which is clearly virtually free of failure or surprise, to a costly if not complicated problem. The cost of deploying one of the boats inside the enclosing tuna net with two or more operators is miniscule compared to the losses faced by the fishing community should the present and future limits on porpoise killings be enforced and no other technology by developed to cope with the problem.

I claim:

1. A porpoise evacuation skiff deployable from a larger fishing vessel to permit direct removal of porpoises from within net, said skiff comprising:

(a) a boat body having a central bay for temporarily confining porpoises;

(b) a ramp descending at least to the waterline of said boat body to permit the hauling of porpoises up said ramp and ascending to the top of said bay to permit easy depositing of the porpoises in said bay without opening said bay to the sea permiting escape of collected porpoises;

(c) an operator stabilizing station adjacent said ramp to secure an operator for hauling porpoises up said ramp, said station having a support upon which said operator can stand and means securing said operator from falling from the skiff.

2. Structure according to claim 1 wherein said bay has a floor disposed beneath the waterline of said boat body and including a gate operable from a position defining a substantially watertight wall of said bay to an open position to permit the ejection of porpoises from said bay directly into the surrounding waters.

3. A porpoise evacuation boat comprising:

(a) a boat body having a central bay for temporarily confining porpoises;

(b) a ramp descending at least to the waterline of said boat body to permit the hauling of porpoises up said ramp and the depositing of the porpoises in said bay;

(c) an operator stabilizing station comprising a well disposed adjacent the edge of said boat body and adjacent said ramp to secure an operator for hauling porpoises up said ramp.

4. Structure according to claim 3 wherein said well is disposed partly beneath the waterline and has an exterior retaining structure permitting the passage of water into said well.

5. Structure according to claim 4 wherein said retaining structure comprises a set of bars defining the exterior portion of said well.

6. Structure according to claim 5 and including a second well disposed adjacent the side of said boat body and on the side of said ramp opposite the first mentioned well such that two operators can work simultaneously to haul out porpoises.

7. Structure according to claim 6 wherein said ramp terminates at its upper end substantially along an edge of said bay.

8. Structure according to claim 6 and including two ramps disposed on opposite sides of said boat body and each of said ramps has a pair of operator stabilizing wells on each side thereof.

* * * * *